US007670207B2

(12) United States Patent
Wadephul

(10) Patent No.: US 7,670,207 B2
(45) Date of Patent: Mar. 2, 2010

(54) IMPELLER FOR FEEDING BLASTING SHOTS INTO A CENTRIFUGAL WHEEL

(76) Inventor: Jost Wadephul, Ketzendorfer Grund 23, 21614 Buxtehude (DE)

( * ) Notice: Subject to any disclaimer, the term of this patent is extended or adjusted under 35 U.S.C. 154(b) by 69 days.

(21) Appl. No.: 11/570,808

(22) PCT Filed: Jun. 24, 2005

(86) PCT No.: PCT/EP2005/006829

§ 371 (c)(1),
(2), (4) Date: Jan. 10, 2008

(87) PCT Pub. No.: WO2006/000426

PCT Pub. Date: Jan. 5, 2006

(65) Prior Publication Data

US 2008/0268754 A1 Oct. 30, 2008

(30) Foreign Application Priority Data

Jun. 24, 2004 (DE) ..... 20 2004 009 959 U

(51) Int. Cl.
*B24C 5/06* (2006.01)

(52) U.S. Cl. ..... 451/95; 451/97; 451/98

(58) Field of Classification Search ..... 451/95, 451/97, 98, 38, 446, 451
See application file for complete search history.

(56) References Cited

U.S. PATENT DOCUMENTS

| | | | | | |
|---|---|---|---|---|---|
| 2,135,510 | A | * | 11/1938 | Hollingsworth | 451/97 |
| 2,204,618 | A | * | 6/1940 | Peik | 451/97 |
| 2,204,632 | A | * | 6/1940 | Turnbull | 451/95 |
| 2,204,635 | A | * | 6/1940 | Turnbull | 451/97 |
| 2,301,508 | A | * | 11/1942 | Blount | 451/97 |
| 2,341,559 | A | | 2/1944 | Keefer | |
| 3,675,373 | A | * | 7/1972 | Putnam | 451/38 |
| 3,768,209 | A | * | 10/1973 | Punter et al. | 451/97 |
| 4,126,280 | A | * | 11/1978 | Burk | 241/275 |
| 5,476,412 | A | * | 12/1995 | Stoltz | 451/75 |
| 5,584,748 | A | * | 12/1996 | Flynn et al. | 451/91 |
| 5,759,091 | A | * | 6/1998 | MacMillan | 451/95 |
| 6,447,378 | B1 | * | 9/2002 | Hoff | 451/95 |
| 6,981,910 | B1 | * | 1/2006 | Goff | 451/91 |
| 2008/0076333 | A1 | * | 3/2008 | Krause et al. | 451/94 |

FOREIGN PATENT DOCUMENTS

| | | |
|---|---|---|
| GB | 654 420 A | 6/1951 |
| SU | 1098776 A | 6/1984 |
| SU | 1114536 A | 9/1984 |

* cited by examiner

OTHER PUBLICATIONS

Russian Office Action.

*Primary Examiner*—Eileen P. Morgan
(74) *Attorney, Agent, or Firm*—Smith, Gambrell & Russell

(57) ABSTRACT

An impeller (2) for feeding blasting shots, which are to be accelerated, into the centrifugal wheel of a blasting installation, the impeller (2) being arranged in the central region of the centrifugal wheel inside a distributing sleeve (1) which has a distributing opening (8) and can be rotated in the direction of rotation of the centrifugal wheel, and the impeller (2) having, in particular platelike, guiding elements which are directed toward the distributing sleeve (1), are intended for guiding the blasting shot to the outside and are arranged on at least one lateral disk (4), and in that in each case at least two adjacent guiding means are designed as limbs (5, 6), interconnected, in particular, integrally, of a profiled piece (3), adjacent limbs (5, 6) of adjacent profiled pieces (3) forming channels (7) through which the blasting shot can be discharged to the outside.

24 Claims, 1 Drawing Sheet

IMPELLER FOR FEEDING BLASTING SHOTS INTO A CENTRIFUGAL WHEEL

STATEMENT OF RELATED APPLICATIONS

This patent application is the Patent Cooperation Treaty (PCT) Chapter II National Phase of, and claims priority on, PCT International Patent Application No. PCT/EP2005/006829 having an International Filing Date of 24 Jun. 2005, which claims priority on German Patent Application No. 20 2004 009 959.4 having a filing date of 24 Jun. 2004, both of which are incorporated herein by this reference.

BACKGROUND OF THE INVENTION

1. Technical Field

The invention relates to an impeller for feeding blasting shots, which are to be accelerated, into the centrifugal wheel of a blasting installation, the impeller being arranged in the central region of the centrifugal wheel inside a distributing sleeve which has a distributing opening and can be rotated in the direction of rotation of the centrifugal wheel, and the impeller having, in particular platelike, guiding elements which are directed toward the distributing sleeve, are intended for guiding the blasting shot to the outside and are arranged on at least one lateral disk.

2. Related Art

Blasting installations equipped with centrifugal wheels are used to free surfaces of metallic rolled products from scale and/or rust before the surface obtains a protective coating of paint by a blasting shot comprising fine metal particles being hurled against the surface. In a centrifugal wheel of this type, not all of the particles of the blasting shot move outward preferably tangentially and as parallel as possible to the blades of the rotating centrifugal wheel when they emerge from the distributing opening of the distributing sleeve. A considerable number of these particles strikes against the lateral disks and the blades and rebounds therefrom, in a manner comparable to a ping-pong ball, which not only has a negative effect on the exit speed of the blasting shot from the centrifugal wheel but also leads to the blasting shot being nonuniformly distributed over the surface to be cleaned. The impacting of the blasting shot particles against the parts of the centrifugal wheel also causes the same to be subject to a high degree of wear.

It is the object of the invention to reduce the degree of wear caused to the centrifugal wheel by the blasting shot and at the same time to produce a blasting pattern uniformly covering the entire ejection angle of the blasting shot from the centrifugal wheel with approximately parallel lateral delimitation.

BRIEF SUMMARY OF THE INVENTION

According to the invention, this object is achieved, starting from an impeller for feeding in blasting shots of the type described at the beginning in that in each case at least two adjacent guiding means are designed as limbs, interconnected, in particular, integrally, of a profiled piece, adjacent limbs of adjacent profiled pieces forming channels through which the blasting shot can be discharged to the outside.

The limbs of the profiled piece expediently point, on the one hand, in the direction of the distributing sleeve and, on the other hand, at least approximately in the direction of the axis of rotation of the impeller.

In a preferred embodiment, those limb ends of the profiled piece which are directed toward the distributing sleeve are spaced apart from one another in the circumferential direction of the impeller, in particular of the lateral disk, with a recess which is accessible from the direction of the distributing sleeve being arranged between the limbs, in particular a cavity into which the blasting shot can penetrate or escape. The recess or the cavity can be formed directly by the limbs.

As far as the spatial orientation of the two limbs of the profiled piece is concerned, they preferably run at an angle to each other, in particular at least in an approximately V-shaped manner or the two limbs form a V shape. At least one limb, preferably both limbs of the profiled piece, can preferably run at an angle to the radial direction of the impeller, in particular of the lateral disk.

In a further embodiment, the limbs of the profiled pieces can be interconnected by a web preferably running at an angle to the limbs. The web can run, for example, in a rectilinear or curved manner. It is furthermore possible for the limbs of the profiled pieces to be designed such that they differ in length. It has also proven successful between the limbs of the profiled pieces to provide preferably platelike transporting elements extending in the direction of the distributing sleeve.

The following is achieved by the configuration according to the invention of the guiding elements as limbs of profiled pieces: first of all, the blasting shot enters from the rotating impeller via the discharging channels with discharging openings at the channel ends into the spaces between distributing sleeve and impeller on an approximately circular path. Subsequently, the blasting shot revolves in this region between distributing sleeve and impeller along this circular path. The forces which act on the blasting shot from the, in particular, free limbs of the profiled pieces and, if appropriate, from the transporting elements between the limbs of the profiled pieces cause the blasting shot finally to be transferred as tangentially as possible from the distributing opening of the distributing sleeve into the operative region of the blades of the centrifugal wheel. This results in a soft transition of the blasting shot into the blade region of the centrifugal wheel over the entire width with subsequent uniform acceleration as far as the exit from the blade. The blasting shot is substantially prevented from impacting against the blades and lateral walls of the centrifugal wheel.

The impact-free transition of the blasting shot from the impeller, which acts as a central accelerator, into the centrifugal wheel brings about a uniform guidance of the blasting shot in the centrifugal wheel, thus not only obtaining a uniform distribution of the blasting shot over the surface to be treated but also reducing the degree of wear at the centrifugal wheel and the energy to be expended in order to accelerate the blasting shot.

BRIEF DESCRIPTION OF THE DRAWINGS

An exemplary embodiment of the present invention is described with reference to the attached drawing, in which.

DETAILED DESCRIPTION OF PREFERRED EMBODIMENTS

Figure 1:
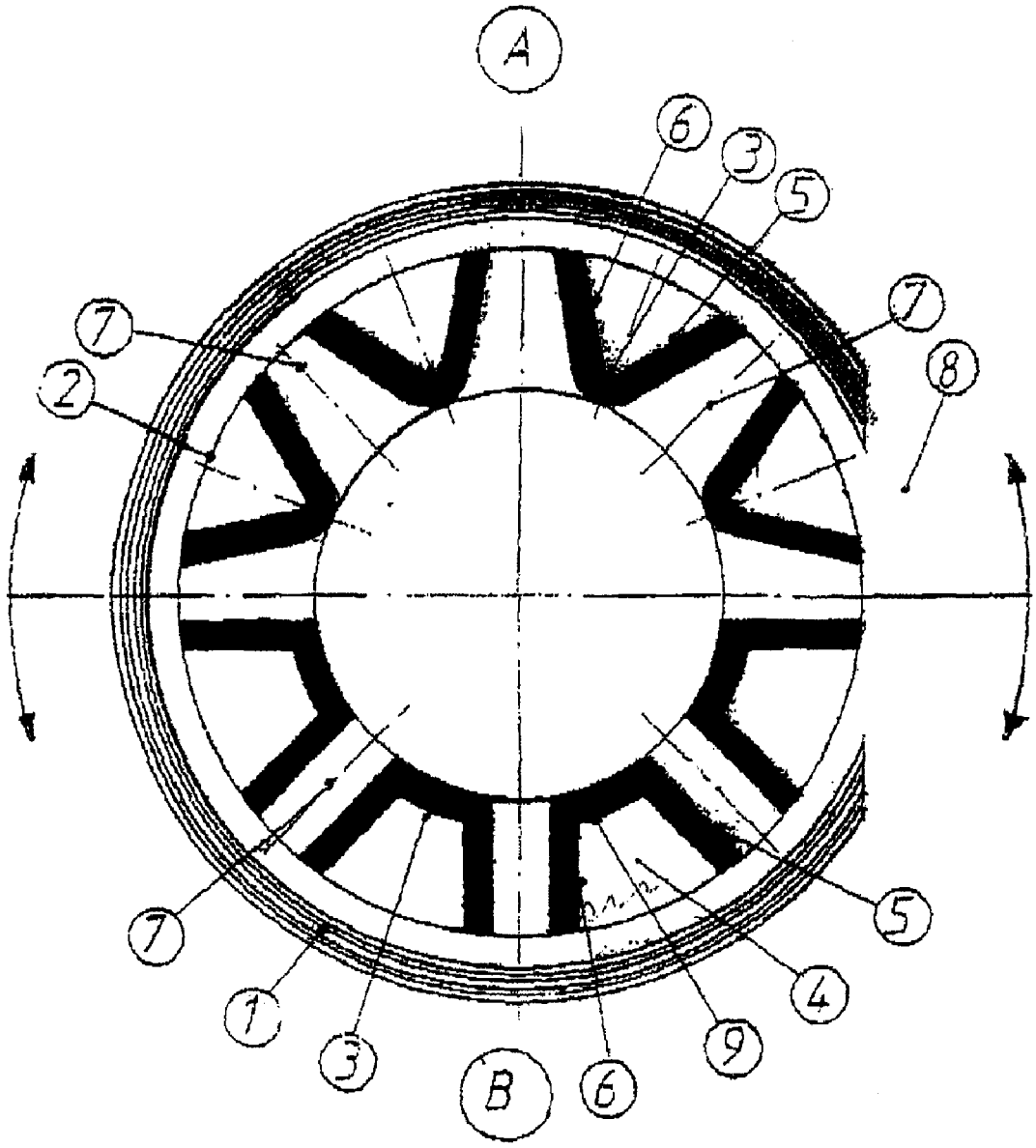
FIG. 1 shows a diagrammatic sectional view of an impeller according to the invention.

FIG. 1 shows, in a schematic sectional view, an impeller 2 which is arranged in the interior of a distributing sleeve 1 of a centrifugal wheel of a blasting installation (not illustrated).

The impeller 2 has profiled pieces 3 which are fastened to one of the end sides of a first lateral disk 4. A second lateral disk (not illustrated) is assigned to the first lateral disk (4) lying opposite it in the axial direction, so that the profiled pieces 3 are arranged between the two lateral disks. It is pointed out that, within the scope of the invention, the profiled pieces 3, in principle, may also be connected integrally to the end side of the lateral disk 4. The profiled pieces 3 are raised in relation to the end-side plane of the lateral disk 4, i.e. they form elevations with respect to this plane.

The individual profiled pieces are distributed in the circumferential direction over the encircling edge region of the end side of the lateral disk 4. In this case, each profiled piece 3 is spaced apart in the circumferential direction from the respectively adjacent profiled piece 3. The profiled pieces 3 each have two limbs 5 and 6 which serve as blasting-shot guiding elements and are interconnected at their ends directed at least approximately to the center of the impeller or to the axis of rotation of the impeller. The limbs 5 and 6 point with their free ends at the distributing sleeve 1, with cavities which are accessible from the direction of the distributing sleeve being formed in each case between the limbs 5 and 6. The profiled pieces 3 are distributed in the circumferential direction over the encircling edge region of the end side of the lateral disk 4 in such a manner that channels 7 are formed between adjacent limbs of adjacent profiled pieces 3.

As far as the limbs 5 and 6 of a profiled piece 3 are concerned, they may describe a V shape, as shown in a sector A of the impeller 2. In another embodiment, the limbs 5 and 6 may also be interconnected via a web 9, cf. sector B, so that the profiled piece 3 is designed overall approximately as a U shape. As a person skilled in the art will recognize, diverse shapes are conceivable here, such as, for example, also an L shape.

The distributing sleeve 1, which is otherwise closed, is provided on the circumference with a discharging opening 8.

During operation of the blasting installation, blasting shot is guided via supply lines (not illustrated) in the axial direction into the center of the impeller 2. The blasting is subsequently guided radially outward from the impeller 2, which is offset into a rotational movement via a drive (not illustrated), along the channels 7. The blasting shot is finally output via the discharging opening 8 into the angular region of the blades of a centrifugal wheel (not shown).

LIST OF REFERENCE NUMBERS

1 Distributing sleeve
2 Impeller
3 Profiled piece
4 Lateral disk
5 Limb
6 Limb
7 Channel
8 Discharging opening
9 Web

What is claimed is:

1. An impeller for feeding blasting shot into a centrifugal wheel of a blasting installation, the centrifugal wheel having a direction of rotation, the impeller (2) being located centrally within the centrifugal wheel and inside a distributing sleeve (1), the distributing sleeve (1) having a distributing opening (8), the impeller (2) being rotatable in the direction of rotation of the centrifugal wheel, and the impeller (2) having guiding elements that are directed toward the distributing sleeve (1) for guiding the blasting shot to outside of the impeller (2), the guiding elements being arranged on at least one lateral disk (4), comprising: at least two adjacent guiding elements designed as interconnected limbs (5, 6) of profiled pieces (3), and recesses that are arranged between the limbs (5, 6) and which are accessible from the direction of the distributing sleeve (1), wherein adjacent limbs (5, 6) of adjacent profiled pieces (3) form channels (7)

through which the blasting shot can be discharged to the outside, wherein the limb ends of the profiled pieces (3) that are directed toward the distributing sleeve (1) are spaced apart from one another in the circumferential direction of the impeller (2) and the lateral disk (4), and wherein the the blasting shot can escape into the recesses.

2. The impeller as claimed in claim 1, wherein the profiled pieces (3) are arranged in such a manner that the free ends of the limbs (5, 6) of the profiled pieces (3) are directed toward the distributing sleeve (1).

3. The impeller as claimed in claim 1, wherein the limbs (5, 6) of the profiled pieces (3) run at a V-shaped angle to each other.

4. The impeller as claimed in claim 1, wherein at least one of the limbs (5, 6) of the profiled pieces (3) runs at an angle to the radial direction of the lateral disk (4) of the impeller (2).

5. The impeller as claimed in claim 1, wherein the limbs (5,6) of the profiled pieces (3) are interconnected via a web.

6. The impeller as claimed in claim 1, wherein the limbs (5, 6) of the profiled pieces (3) have different lengths.

7. The impeller as claimed in claim 2, wherein at least one of the limbs (5, 6) of the profiled pieces (3) runs at an angle to the radial direction of the lateral disk (4) of the impeller (2).

8. The impeller as claimed in claim 2, wherein the limbs (5, 6) of the profiled pieces (3) are interconnected via a web.

9. The impeller as claimed in claim 2, wherein the limbs (5, 6) of the profiled pieces (3) have different lengths.

10. The impeller as claimed in claim 3, wherein at least one of the limbs (5, 6) of the profiled pieces (3) runs at an angle to the radial direction of the lateral disk (4) of the impeller (2).

11. The impeller as claimed in claim 3, wherein the limbs (5, 6) of the profiled pieces (3) are interconnected via a web.

12. The impeller as claimed in claim 3, wherein the limbs (5, 6) of the profiled pieces (3) have different lengths.

13. The impeller as claimed in claim 4, wherein the limbs (5, 6) of the profiled pieces (3) are interconnected via a web.

14. The impeller as claimed in claim 4, wherein the limbs (5, 6) of the profiled pieces (3) have different lengths.

15. The impeller as claimed in claim 5, wherein the limbs (5, 6) of the profiled pieces (3) have different lengths.

16. The impeller as claimed in claim 1, wherein the limbs (5, 6) of the profiled pieces (3) form a V-shape relative to each other.

17. The impeller as claimed in claim 1, wherein the limbs (5, 6) of the profiled pieces (3) are integrally interconnected to each other.

18. The impeller as claimed in claim 1, wherein the guiding elements are platelike guiding elements.

19. The impeller as claimed in claim 1, wherein the recess is a cavity.

20. An impeller for feeding blasting shots into a centrifugal wheel of a blasting installation, wherein the centrifugal wheel has a direction of rotation, the impeller (2) is located inside a distributing sleeve (1) and centrally within the centrifugal wheel, the distributing sleeve (1) has a distributing opening (8), and the impeller (2) is rotatable in the direction of rotation of the centrifugal wheel, the impeller (2) comprising guiding elements that are directed toward the distributing sleeve (1)

for guiding the blasting shot to outside of the impeller (2), the guiding elements being arranged on at least one lateral disk (4), wherein:

at least two adjacent guiding elements are interconnected as limbs (5, 6) of profiled pieces (3);

the limbs (5, 6) of the profiled pieces (3) have free ends that are directed toward the distributing sleeve (1) and that are spaced apart from one another in the circumferential direction of the impeller (2) and of the lateral disk (4);

the profiled pieces (3) are distributed in a circumferential direction over an encircling edge region of the lateral disk (4) such that adjacent limbs (5, 6) of adjacent profiled pieces (3) form channels (7) through which the blasting shot can be discharged to the outside; and the profiled pieces (3) have recesses located between the limbs (5, 6) that are accessible from the direction of the distributing sleeve (1) into which the blasting shot can escape.

21. The impeller as claimed in claim 20, wherein the limbs (5, 6) of the profiled pieces (3) form a V-shape relative to each other.

22. The impeller as claimed in claim 21, wherein the limbs (5, 6) of the profiled pieces (3) are integrally interconnected to each other.

23. The impeller as claimed in claim 22, wherein the guiding elements are platelike guiding elements.

24. The impeller as claimed in claim 23, wherein the recess is a cavity.

* * * * *